US006112949A

United States Patent [19]

Rhodes et al.

[11] Patent Number: 6,112,949

[45] Date of Patent: Sep. 5, 2000

[54] DUAL CAP DISPENSER

[75] Inventors: Robert V. Rhodes, 1118 Stratford Ave., South Pasadena, Calif. 91030; Dennis Radersma, Monrovia, Calif.

[73] Assignee: Robert V. Rhodes, Pasadena, Calif.

[21] Appl. No.: 09/162,381

[22] Filed: Sep. 28, 1998

[51] Int. Cl.[7] ..... B67D 5/06

[52] U.S. Cl. ..... 222/153.02; 222/153.06; 222/182; 222/530; 222/538

[58] Field of Search ..... 222/529, 530, 222/538, 153.02, 182, 153.06

[56] References Cited

U.S. PATENT DOCUMENTS

| | | | |
|---|---|---|---|
| 2,974,835 | 3/1961 | Herbrick | 222/507 |
| 3,298,575 | 1/1967 | Larsen | 222/399 |
| 3,300,099 | 1/1967 | Marona | 222/207 |
| 3,595,427 | 7/1971 | Markowitz | 222/182 X |
| 3,860,148 | 1/1975 | Sherin . | |
| 3,923,211 | 12/1975 | Spreen | 222/528 |
| 4,216,880 | 8/1980 | Drelichowski | 222/83 |
| 4,426,027 | 1/1984 | Maynard, Jr. | 222/530 X |
| 4,492,324 | 1/1985 | Weber | 222/530 X |
| 4,583,668 | 4/1986 | Maynard, Jr. | 222/529 |
| 4,602,728 | 7/1986 | Ha | 222/528 |
| 5,088,632 | 2/1992 | Odet et al. | 222/530 X |
| 5,104,012 | 4/1992 | McAllister et al. | 222/528 |
| 5,133,481 | 7/1992 | Mayfield | 222/529 X |
| 5,655,685 | 8/1997 | Carr et al. | 222/153.02 |
| 5,722,570 | 3/1998 | Sultzer, III et al. | 222/529 |

FOREIGN PATENT DOCUMENTS

| | | | |
|---|---|---|---|
| 0385104 | 9/1990 | European Pat. Off. | 222/530 |
| 2615827 | 12/1988 | France | 222/530 |
| 3906322 | 9/1989 | Germany | 222/530 |
| 3906323 | 9/1989 | Germany | 222/530 |

*Primary Examiner*—Joseph A. Kaufman
*Attorney, Agent, or Firm*—Christie, Parler & Hale

[57] ABSTRACT

A dual cap dispenser has an inner cap connected to a bottle and an outer cap is detachably connected to the inner cap. There is a longitudinally extendable bellows-like tube connected to the inner cap and having an outer end closed by the outer cap. Preferably, the bellows-like tube is semi-rigid and comprises three stable states. A first state has the sides of a fold of the bellows collapsed against each other. A second state has the sides of the fold spaced apart from each other when the tube is extended. The third state has a fold on one side of the tube collapsed while the same fold on the diametrically opposite side of the tube is expanded, thereby providing an opportunity to have a curved dispensing tube. The inner cap is threaded on the bottle and the outer cap is connected to the inner cap by a bayonet fitting or similar "quick release" arrangement. Tamper evident connections may be made between the inner and outer caps, and between the inner cap and the bottle. If so, the connection between the caps is made weaker than the connection between the inner cap and bottle.

17 Claims, 4 Drawing Sheets

DUAL CAP DISPENSER

BACKGROUND OF THE INVENTION

A commonplace annoyance, and sometimes a hazard, involves the pouring of liquids from a bottle or like into another bottle or a hole. For example, motor oil or other automobile fluids may be poured from a bottle into a fill hole hidden in a tangle of other components under the hood of a car. It is difficult to start the pouring without spilling oil. One often wishes to pour cleaning solutions, shampoos, cooking oil or other household liquids from a large container into a smaller container for more convenient usage. Again spillage is not a bit uncommon.

To avoid such problems one may use a funnel, but this is just one more piece to clean and store between uses. Preferably, one may use a pouring spout placed on a larger bottle to facilitate pouring into another bottle, hole or other orifice. Flexible pouring spouts are sometimes connected to replacement covers to be screwed onto a bottle for more convenient pouring. Each known embodiment of such pouring spouts has disadvantages and it would be desirable to provide an improvement that facilitates clean and easy pouring. Desirably this may be provided as part of the original package. This way one does not need to hunt for a pouring spout when it is needed and the pouring spout may be made of materials compatible with the liquid to be poured. When such a pouring spout is installed on a bottle before sale, it may be desirable to provide a tamper evident closure so that a purchaser has confidence that the contents of the container have not been contaminated.

SUMMARY OF THE INVENTION

Thus, there is provided in practice of this invention according to a presently preferred embodiment, a dual cap dispenser for a screw top container. An inner cap is threaded onto the container, a longitudinally extendable dispenser tube is sealed to the inner cap, and an outer cap is engaged with the inner cap so that the outer cap is removable without removing the inner cap from the container. The outer cap includes means for sealing to the outer end of the dispenser tube so that the material in the container does not leak out. Preferably, the dispenser tube is a semirigid collapsible tube with two stable states. One of these states has the folds of a bellows-like tube collapsed against each other and the other state has the folds of the bellows spaced apart from each other. A third stable state may have one side of a fold collapsed and the diametrically opposite side on the same fold having the sides spaced apart from each other.

DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION OF THE INVENTION

Figure 1:
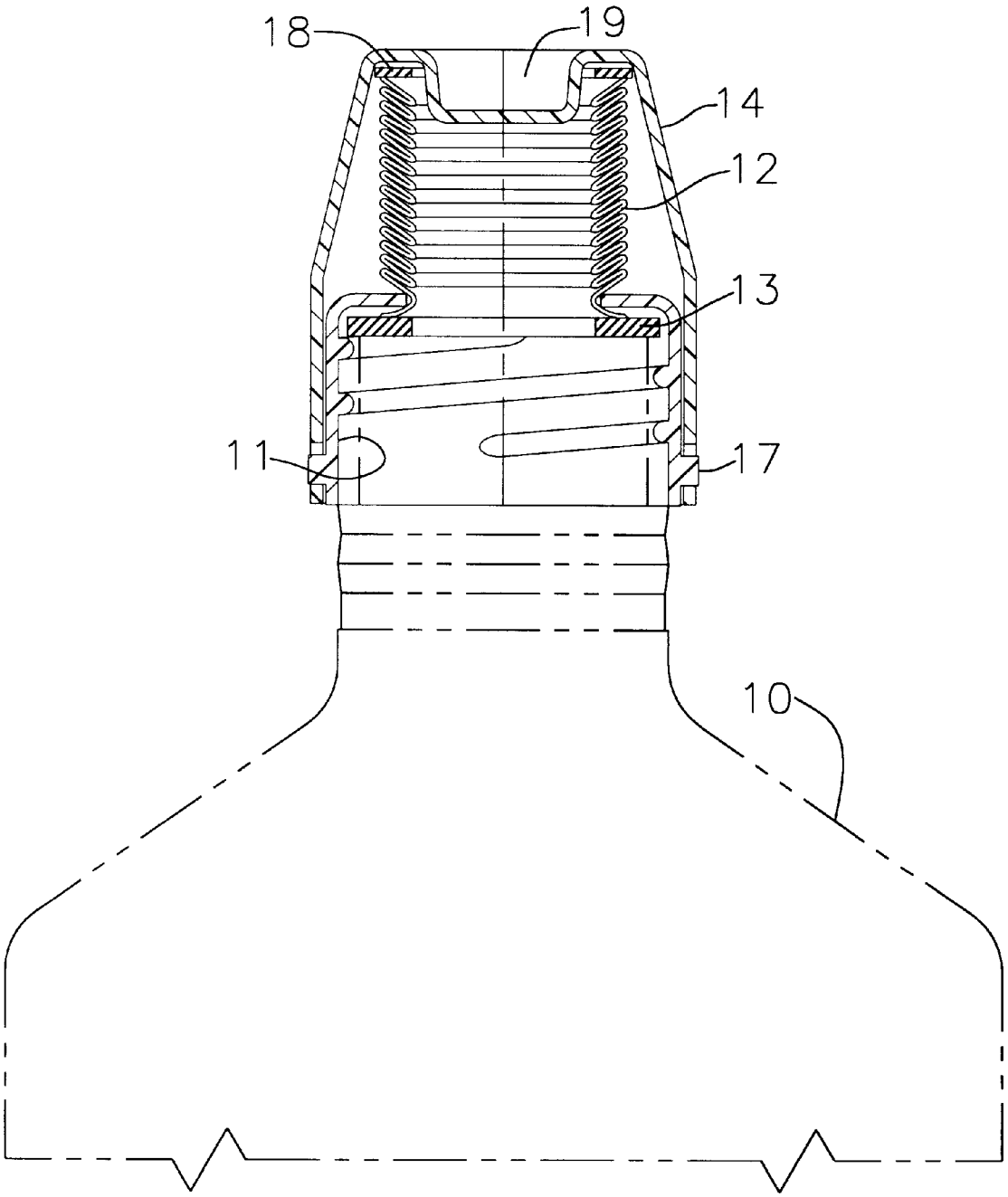
FIG. 1 illustrates a longitudinal cross-section of a dual cap dispenser mounted on a container and in a collapsed state as it would be sold.

As illustrated in FIG. 1, a dual cap dispenser is connected to a conventional bottle 10 by a screw thread. A dual cap dispenser has an inner cap 11 which is threaded onto the bottle top. A bellows-like extensible tube 12 is secured to or integral with the inner cap. In the embodiment illustrated herein there is a resilient gasket 13 which seals between the end of the dispenser tube and the top of the bottle. Thus, the tube itself need not be sealed to the cap directly, although it is preferred that the cap also seal against the top of the bottle to prevent leakage. Instead of a separate gasket, a resilient polymer applied inside the inner cap may seal the cap to the bottle and also seal the tube to the cap and enhance a mechanical connection of the tube to the cap.

Figure 3:
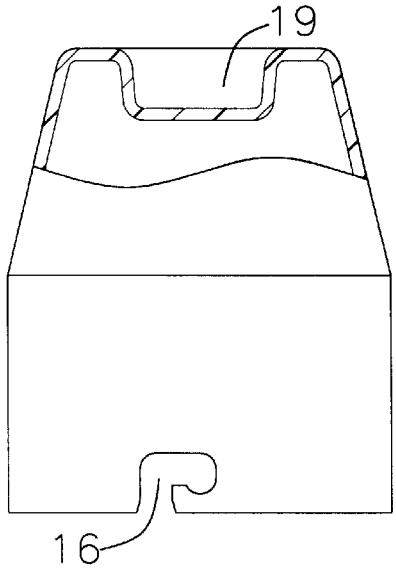
FIG. 3 is a side view, partly cutaway, of the outer cap of the dual cap dispenser.

An outer cap 14 is releasably connected to the inner cap, preferably by a bayonet style connection. The outer cap has two J-shaped slots 16 (FIG. 3) which mate with short studs 17 on opposite sides of the inner cap. The outer cap is removed from the inner cap by pressing down slightly, rotating the outer cap a few degrees and lifting the outer cap. The collapsible tube acts as a spring for pressing the outer cap down. The J-shaped slots are oriented so that as one connects the outer cap to the inner cap, the threaded connection between the inner cap and bottle is tightened. Other "quick release" connections may be equivalent to the J-slot bayonet type fitting.

A resilient sealing material 18 is provided inside the cap for sealing against the end of the dispensing tube. The sealing material may be an elastomeric gasket (as illustrated herein) or a resilient polymer deposited as a ring in the top of the cap. A circular depression 19 in the upper end of the cap raises a central projection inside the cap, which aids in centering the cap on the dispensing tube when it is being closed.

Figure 2:
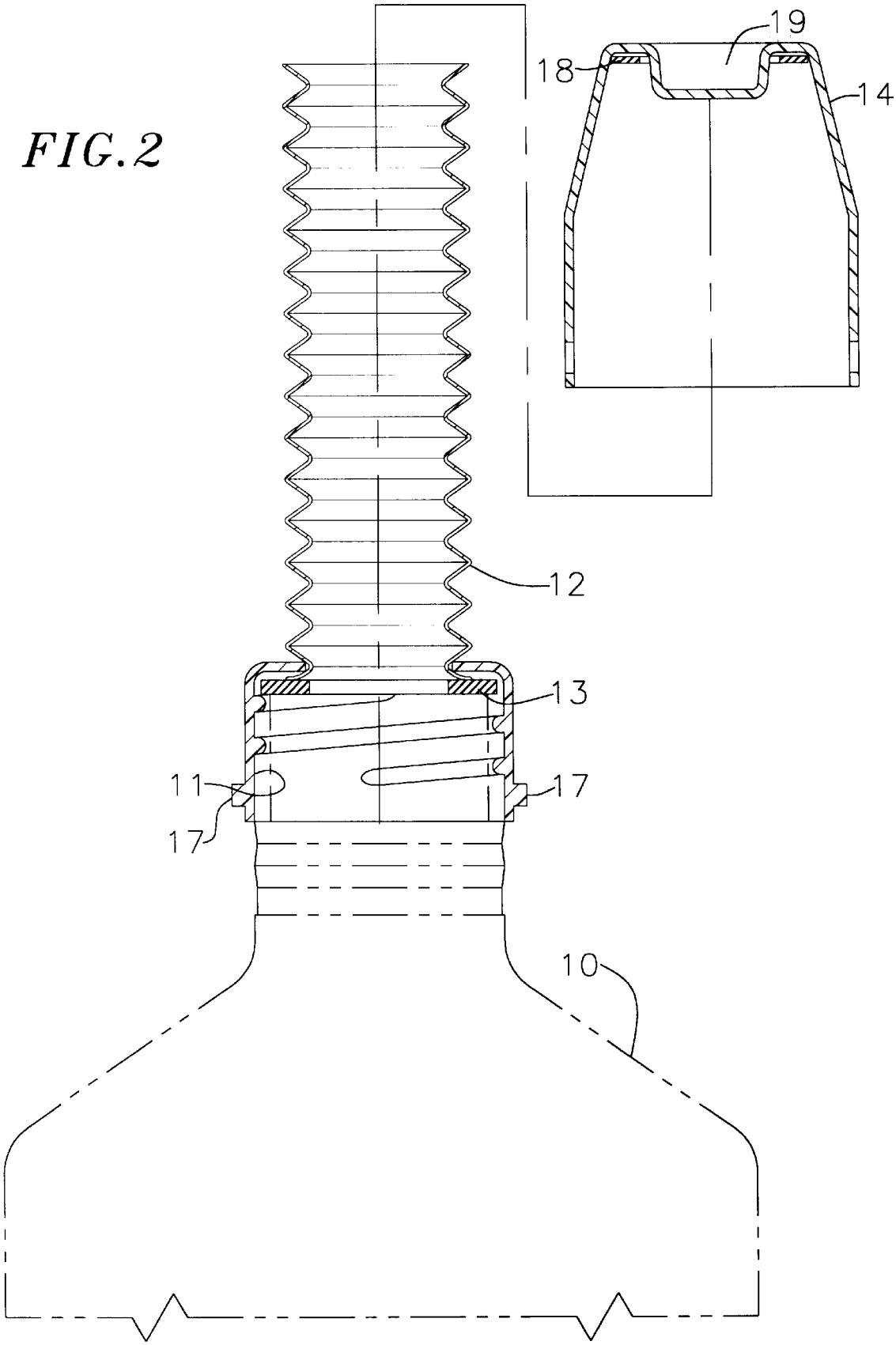
FIG. 2 illustrates the dual cap dispenser with a collapsible tube extended as it would be when the dispenser is ready for use.

The dispensing tube has a bellows-like configuration, with a series of inner and outer circumferential accordion folds along the length. Alternate folds in the wall of the bellows face inwardly and outwardly, respectively. This permits the tube to be collapsed so that the folds are adjacent each other as illustrated in FIG. 1, or alternatively, the folds can be extended as illustrated in FIG. 2 to lengthen the dispensing tube. This permits the tube to be short and contained between the two caps when the outer cap is secured to the inner cap for storage, shipping and handling. Alternatively, the bellows can be extended to make an elongated pouring spout.

Preferably the dispensing tube is semi-rigid, i.e., it remains in a bent or other shape once it has been bent to that shape. This facilitates pouring. Typically the tube is made of polyethylene with rather short radius turns at the inside and outside extremities of each fold of the bellows. There is a substantially straight portion (as viewed in longitudinal cross section) between the inner and outer parts of the bellows so that the straight portions can fit together fairly closely when the tube is collapsed.

A suitable material for forming the semirigid collapsible tube is available in various sizes from Cleveland Tubing Inc.

of Cleveland, Tenn. The tubing has the interesting property of having two stable states: When the folds of the bellows are collapsed against each other, the tubing stays in this collapsed state with no tendency to expand. Conversely, when the tubing is extended with the V-shaped folds pulled apart from each other, the tubing is again stable and has no tendency to collapse. In either of these states, the portion of the tubing between adjacent inner and outer folds is in the form of a truncated cone. When the tubing is expanded as illustrated in FIG. 2, successive cones face in opposite directions. When the tubing is collapsed as illustrated in FIG. 1, successive cones face in the same direction. To change from one state to the other, the cones must be deformed "over center" to toggle between stable states.

Figure 4:
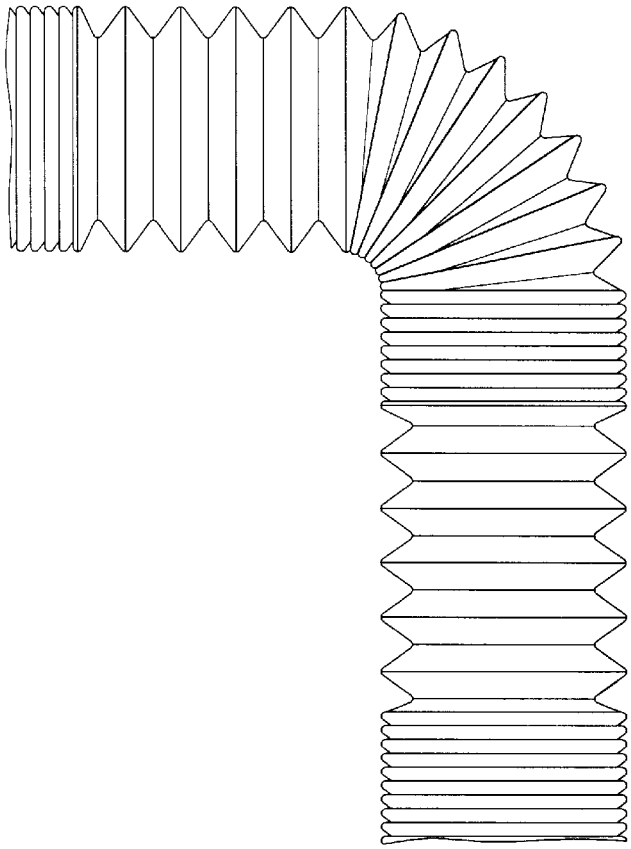
FIG. 4 is a side view of a dispenser tube bent into a position for pouring.

Even more interesting, the tubing has a third stable state when a fold on one side of the tubing is collapsed and on the diametrically opposite side of the tubing the same fold is expanded. This means that one can press the tubing toward one side so that the folds are collapsed on one side of the tubing, and on the opposite side of the tubing the folds are expanded, yielding a curved pouring spout such as the right angle bend illustrated in FIG. 4. Since the tubing is stable in this position, a curved pouring spout can be preformed to fit a hole before starting to pour. Since each fold of the tubing has three stable states, the dispensing tube as a whole can be in several conditions. For example, one or more folds may be completely collapsed, one or more folds may be completely extended, and additional folds may be half collapsed and half extended. Furthermore, in this third stable state, the configuration of adjacent folds may be opposite so that a tube may be bent into a gentle S-shape.

This type of tubing is connected to the inner cap as follows: A piece of tubing is cut at the peak of the outer fold. This larger diameter portion before the next inner fold is pressed through the opening in the top of the inner cap, where it snaps outwardly to a larger diameter than the opening. It turns out that the resulting connection between the tubing and cap is quite resistant to being pulled apart.

It is often desirable for the purchasing public to be able to check a bottle of product being purchased before buying it, to be able to determine whether the bottle has been previously opened with the attendant possibility of contamination or adulteration. Thus, it has become commonplace for products to be sealed with a cap attached to the bottle with a tamper evident closure. This often takes the form of a circumferential row of holes between the cap and a band that fits around the neck of the bottle. When the cap is unscrewed, narrow webs of material between the holes are ruptured before the cap can come off of the bottle. Thus, a consumer can check the bottle and if the tamper evident connection is intact, there is confidence that the bottle has not been opened, whereas if the webs around the tamper evident connection are broken, the cap may have been removed.

Figure 5:
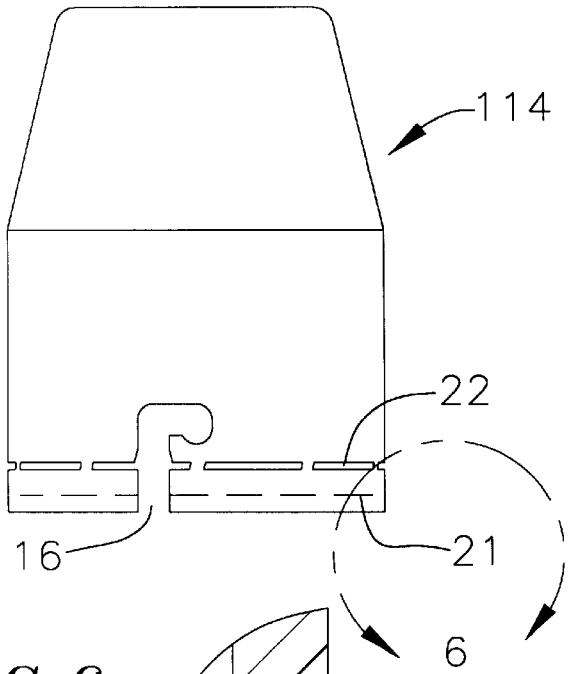
FIG. 5 is a side view of an outer cap with a tamper evident closure.
Figure 6:
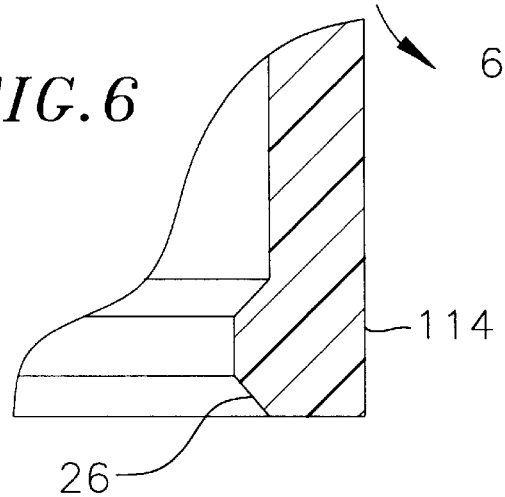
FIG. 6 is a fragmentary detail of the lower edge of the outer cap of FIG. 5.
Figure 7:
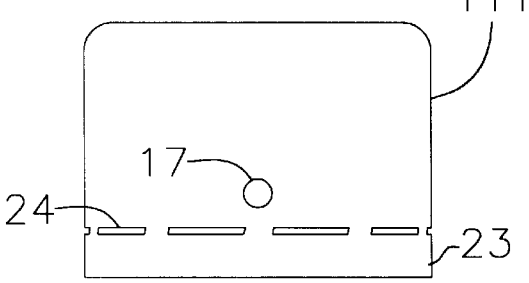
FIG. 7 is a longitudinal cross-section of an exemplary inner cap having a tamper evident closure.

FIG. 5 to 7 illustrate a second embodiment of outer cap and inner cap for the dual cap dispenser where both the inner and outer caps each have a tamper evident connection. The outer cap has a band 21 around its lower or open end which is connected to the balance of the cap by small webs of material between the holes in a row of holes 22 extending circumferentially around the cap. The roll of holes crosses the longer leg of the J-shaped slot 116 used for the bayonet fitting of the outer cap onto an inner cap.

Similarly the inner cap 111 has a band 23 at its lower or open end connected to the balance of the cap by small webs of material between the holes in a row of holes 24 extending circumferentially around the cap. The row of webs between the holes in the inner cap are relatively stronger than the row of webs between the holes in the outer cap. The greater strength can be provided by many stratagems including, for example, greater thickness of material at the row of holes, greater circumferential length of the webs between holes, shaping of the holes for differing stress concentrations, stronger material in the inner cap and combinations of such variations.

The band 21 at the end of the outer cap has an internal circumferential bead 26, the inside diameter of which is smaller than the outside diameter of the inner cap. When the inner and outer cap are assembled with the dispensing tube compressed therebetween, the circumferential bead is below (i.e. closer to the bottle) the lower end of the inner cap. This bead on the outer cap inhibits removal of the band from the inner cap with a greater resistance than resistance to breakage at the row of holes 22 around the outer cap. Thus, the tamper evident closure will be disrupted before the band comes off of the inner cap.

Thus, when the bottle is sitting on the shelf waiting to be sold, the two bands and rows of holes provide two tamper evident closures. One tamper evident closure is between the inner cap and the bottle, and the other is between the outer cap and inner cap. The tamper evident closure between the inner and outer caps is made weaker so that when one attempts to remove the outer cap from the bottle, the tamper evident closure between the caps ruptures before the one between the inner cap and bottle.

Figure 8:
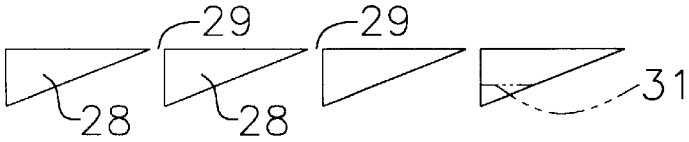
FIG. 8 illustrates schematically a line of openings in a tamper evident closure.

FIG. 8 illustrates a fragment of a row of holes such as may be provided between the upper cap and band hereinabove described or may be used between a conventional cap and a bottle. This row of holes is triangular for applying asymmetrical stresses on the webs 29 between the holes which connect the cap and band. One point of the triangle adjacent to the web is a small acute angle i.e., less than about 30°. The other point of the triangle adjacent to a web has an included angle greater than 60° and preferably approximately a right angle. Because of the substantial asymmetry of the holes, a greater stress should be applied to the webs adjacent the relatively sharp point of a hole as compared with the stress applied adjacent to the relatively more blunt point. Such an arrangement is desirable for making a weak tamper evident closure which can be readily loosened by a consumer.

It will be recognized that the triangular holes illustrated in FIG. 8 are somewhat idealized and that the sharp point of the triangle will be somewhat rounded or blunted so as to be something that can be manufactured. The outline of the hole would remain much as illustrated, but with some blunting of the corners of the hole. It will also be recognized that the third point of the triangle (remote from the locus of rupture of the connection) is relatively unimportant and could essentially be cut off by additional material filling the hole to an exemplary line 31. Thus, instead of a triangle, the hole would have the shape of a quadrangle. This is considered to be equivalent to a triangle, as would other shapes having sharp and blunt angles adjacent to the line of webs for applying asymmetrical stresses along the line of rupture of the connection.

Many modifications and variations of the dual cap dispenser will be apparent to those skilled in the art. Thus, instead of the special semi-rigid tubing with three stable states, one may employ other bellows-like tubing which can be collapsed between the inner and outer caps or extended when the outer cap is removed.

Although it is preferred that a bayonet type connection be made between the inner and outer caps, it will be apparent that a threaded connection may also be used. If so, it is generally preferred that a tamper evident connection be made between the inner cap and bottle so that when the outer cap is unthreaded it does not inadvertently also remove the inner cap. The relative dimensions of caps and tube illustrated herein are merely exemplary and may, of course, be varied as desired for a particular application. Because of such variations and others, it will be apparent that within the scope of the appended claims this invention may be practiced otherwise than as specifically described and illustrated.

What is claimed is:

1. A dual cap dispenser comprising:

a screw top container;

an inner cap threaded onto the container;

a longitudinally extendible dispenser tube sealably secured to the inner cap;

an outer cap engaged with the inner cap and removable without removing the inner cap from the container, the outer cap including means for sealing to the outer end of the dispenser tube; and a first tamper evident connection between the container and the inner cap and a second tamper evident connection between the outer cap and the inner cap, the second tamper evident seal being less resistant to rupture than the first tamper evident seal.

2. A dispenser according to claim 1 further comprising a gasket inside the inner cap and sealing against the end of the dispenser tube and top of the container.

3. A dispenser according to claim 1 wherein the dispenser tube is a semi-rigid collapsible tube.

4. A dispenser according to claim 1 further comprising a bayonet connection for engaging the outer cap with the inner cap.

5. A dispenser according to claim 4 wherein the bayonet connection disengages in the same direction as the thread between the inner cap and the container.

6. A dispenser according to claim 1 wherein the dispenser tube is a pleated bellows-like tube comprising three stable states, a first state having the sides of a fold of the bellows collapsed against each other, a second state having the sides of a fold of the bellows spaced apart from each other, and a third state having one side of a fold collapsed and the diametrically opposite side on the same fold having the sides spaced apart from each other.

7. A dual cap dispenser comprising:

an inner cap connected to a bottle;

an outer cap detachably connected to the inner cap;

a longitudinally extendible bellows-like tube connected to the inner cap and having an outer end closed by the outer cap; and a first tamper evident seal between the inner cap and the bottle and a second tamper evident seal between the outer cap and the inner cap, the first tamper evident seal being stronger than the second tamper evident seal.

8. A dispenser according to claim 7 wherein the bellows-like tube comprises two stable states, one state having the folds of the bellows collapsed against each other and the other state having the folds of the bellows spaced apart from each other.

9. A dispenser according to claim 7 wherein the bellows-like tube comprises three stable states, a first collapsed state having the sides of a fold of the bellows collapsed against each other, a second expanded state having the sides of a fold of the bellows spaced apart from each other, and a third state having one side of a fold collapsed and the diametrically opposite on the same fold being expanded.

10. A dispenser according to claim 7 wherein each tamper evident seal comprises a circumferentially extending row of perforations and webs between perforations, the aggregate area of the spaces between perforations in the first seal being greater than the aggregate area of the webs between perforations in the second seal.

11. A dispenser according to claim 7 wherein the perforations of at least one of the tamper evident seals are substantially triangular and the triangles are asymmetrical.

12. A dispenser according to claim 7 wherein the perforations of at least one of the tamper evident seals have a relatively sharp included angle adjacent to a web between adjacent perforations and a second relatively blunt included angle adjacent to another web.

13. A dual cap dispenser comprising:

an inner cap;

a threaded connection connecting the inner cap to a bottle;

an outer cap;

a bayonet connector connecting the outer cap to the inner cap, the bayonet connector disengaging in the same direction as the threads;

a semi-rigid collapsible tube connected to the inner cap and closed by the outer cap, the tube having a plurality of circumferentially extending accordion folds and two stable states, one state having the folds collapsed against each other and the other state having the folds spaced apart from each other; and a first tamper evident connection between the container and the inner cap and a second tamper evident connection between the outer cap and the inner cap, the second tamper evident seal being less resistant to rupture than the first tamper evident seal.

14. A dispenser according to claim 13 wherein the means for connecting the inner cap to the bottle comprises a threaded connection and the threads disengage in the same direction as the bayonet connector.

15. A dispenser according to claim 13 wherein the dispenser tube comprises three stable states:

a first state having the sides of a fold collapsed against each other, a second state having the sides of a fold spaced apart from each other, and a third state having one side of a fold collapsed and the same fold on the diametrically opposite side of the tube having the sides spaced apart from each other.

16. A dual cap dispenser comprising:

an inner cap connectable to a container;

an outer cap and a bayonet fitting for connecting the outer cap to the inner cap;

a first tamper evident seal between the inner cap and the bottle and a second tamper evident seal between the outer cap and the inner cap, the first tamper evident seal being stronger than the second tamper evident seal; and a semi-rigid dispenser tube connected at one end to the inner cap and having the other end closable by the outer cap, the dispenser tube comprising a plurality of circumferential folds, alternately facing inwardly and outwardly to form a bellows-like shape, the tube having three stable states:

a first state having the opposite sides of a fold collapsed against each other, a second state having the opposite sides of a fold spread apart from each other, and a third state having part of the opposite sides of a fold collapsed against each other and a diametrically opposite side of the tube having the opposite sides of the same fold spread apart from each other.

17. A dispenser according to claim 16 wherein the inner cap is connectable to the container with a thread, and the bayonet fitting disengages in the same direction as the thread between the inner cap and the container.

* * * * *